US005740567A

United States Patent [19]

Mitchell

[11] Patent Number: 5,740,567

[45] Date of Patent: Apr. 21, 1998

[54] BLANKET WITH WATERPROOF FRICTIONAL BACKING

[76] Inventor: Kimberly E. Mitchell, 917 Pineapple Rd., South Daytona, Fla. 32119

[21] Appl. No.: 822,786

[22] Filed: Mar. 24, 1997

[51] Int. Cl.[6] ..... A47G 9/06

[52] U.S. Cl. ..... 5/420; 5/925; 4/582; 428/78

[58] Field of Search ..... 5/417–420, 925, 5/926; 4/582, 583; 428/78

[56] References Cited

U.S. PATENT DOCUMENTS

| | | | |
|---|---|---|---|
| 2,803,836 | 8/1957 | Hunsicker | 5/924 |
| 3,664,628 | 5/1972 | Noble | 5/417 |
| 4,147,828 | 4/1979 | Heckel et al. | 5/420 |
| 4,278,719 | 7/1981 | Sarnecki | 5/420 |
| 4,457,032 | 7/1984 | Clarke | 297/230 |
| 5,018,230 | 5/1991 | Steberger | 5/420 |
| 5,386,603 | 2/1995 | Drust | 5/417 |
| 5,394,575 | 3/1995 | Wolter et al. | 5/419 |
| 5,414,881 | 5/1995 | Terrazas | 5/417 |
| 5,427,834 | 6/1995 | Sodetz | 5/420 |

FOREIGN PATENT DOCUMENTS

| | | | |
|---|---|---|---|
| 589747A1 | 3/1994 | European Pat. Off. | 5/417 |
| 2510863 | 9/1976 | Germany | 5/420 |

*Primary Examiner*—Alexander Grosz
*Attorney, Agent, or Firm*—Paul S. Rooy

[57] ABSTRACT

A blanket with waterproof frictional backing comprising an upper layer attached to a lower layer, and frictional strips attached to the lower layer. The upper layer is a non-abrasive textile such as canvas or terrycloth, and is intended to provide a comfortable seating surface for an occupant. The lower layer is a waterproof material such as plastic or nylon, and serves to protect an occupant from a wet surface upon which the blanket with waterproof frictional backing rests. The frictional strips are fabricated of a material such as rubber or other suitable material, and are intended to prevent the blanket with waterproof frictional backing from slipping on a wet surface, thus enhancing the comfort of an occupant as well as decreasing safety risk.

8 Claims, 2 Drawing Sheets

BLANKET WITH WATERPROOF FRICTIONAL BACKING

BACKGROUND OF THE INVENTION

1. Field of the Invention

This invention relates to blankets, and in particular to a backed blanket with waterproof frictional backing.

2. Background of the Invention

A major problem associated with outdoor activities where humidity is present is finding a dry place to sit. For example, in a swimming pool environment, the area immediately surrounding the pool is frequently wet due to swimmers splashing while swimming, or because bathers have jumped into the water, etc. While it is uncomfortable to sit on a wet surface, there could be an even more serious problem: health risk. Especially if the ambient temperature is cold, the chances of catching a cold or flu increase where an individual is sitting on a wet surface, and thus becomes wet himself.

Another persistent problem associated with finding a suitable place to sit in a swimming pool environment is the rough nature of most swimming pool decks. An individual sitting on a pool deck runs the risk of snagging his or her swimming suit on a rough part of the pool deck, and causing a run in the swimming suit material. This problem is especially severe where the swimming suit is made of a synthetic material such as nylon, lycra, etc.

These outdoor seating problems are not limited to the pool deck. Other examples of difficult outdoor sitting situations include outdoor bleachers at sporting events, wet beach sand, outdoor picnic locations, etc. In short, anywhere where a sitting surface may be wet may present the problem of lack of suitable seating space.

These problems are exacerbated by the slippery nature of many wet surfaces. For example, the area immediately adjacent a swimming pool may be slippery when wet, and outdoor bleacher seating which has been rained on could be easily slipped on. This problem is significant: every year, many thousands of individuals are injured in slip-and-fall accidents caused by unsafe, slippery surfaces. Therefore, it is desirable that any proposed solution to the outdoor seating problem on wet surfaces also provide a way to avoid the danger of slipping.

Another problem exists in the inverse situation: where an individual may be wet, and a surface upon which the individual desires to sit should be protected from dampness. One example is where an individual has been swimming, and is clothed in a wet swimming suit. It would then be desirable to protect a surface upon which the individual sits, such as automobile seat upholstery or other furniture upholster, from damage caused by humidity.

Existing Designs

A number of existing designs teach waterproof backed blankets which combine a non-waterproof upper layer attached to a waterproof lower layer. For example, U.S. Pat. Nos. 4,278,719, 5,386,603, 5,414,881 and 5,427,834 were granted to Sarnecki, Drust, Terrazas and Sodetz respectively for waterproof backed blankets. While these inventions all taught an upper, non-waterproof layer attached to a lower, waterproof layer, none of them addressed the problem of how to immobilize the waterproof backed blanket on a slippery, wet surface.

SUMMARY OF THE INVENTION

Accordingly, it is an object of the present invention to provide a blanket with waterproof frictional backing which provides a dry, upper seating surface. Design features allowing this object to be accomplished include an upper layer attached to a waterproof lower layer. Advantages associated with the accomplishment of this object include increased user comfort and decreased health risk.

It is another object of the present invention to provide a blanket with waterproof frictional backing which presents a frictional surface to a surface upon which it rests. Design features allowing this object to be accomplished include frictional strips attached to a lower layer. Benefits associated with the accomplishment of this object include a more stable seating surface and consequent enhanced safety.

It is still another object of this invention to provide a blanket with waterproof frictional backing which incorporates a smooth, non-snag seating surface. Design features enabling the accomplishment of this object include a smooth upper layer top surface. An advantage associated with the realization of this object is the avoidance of the user snagging a garment on the blanket with waterproof frictional backing, and in so doing, damaging the garment.

It is another object of the present invention to provide a blanket with waterproof frictional backing which is capable of protecting a surface from an occupant's wet clothing. Design features allowing this object to be accomplished include an upper layer attached to a waterproof lower layer. A benefit associated with the accomplishment of this object is the avoidance of water damage to the surface upon which the blanket with waterproof frictional backing rests.

It is yet another object of this invention to provide a blanket with waterproof frictional backing which is inexpensive to manufacture. Design features allowing this object to be achieved include the use of components made of readily available materials. Benefits associated with reaching this objective include reduced cost, and hence increased availability to the consumer.

BRIEF DESCRIPTION OF THE DRAWINGS

The invention, together with the other objects, features, aspects and advantages thereof will be more clearly understood from the following in conjunction with the accompanying drawings.

Two sheets of drawings are provided. Sheet one contains FIGS. 1 and 2. Sheet two contains FIGS. 3 and 4.

DETAILED DESCRIPTION OF THE PREFERRED EMBODIMENT

Figure 1:
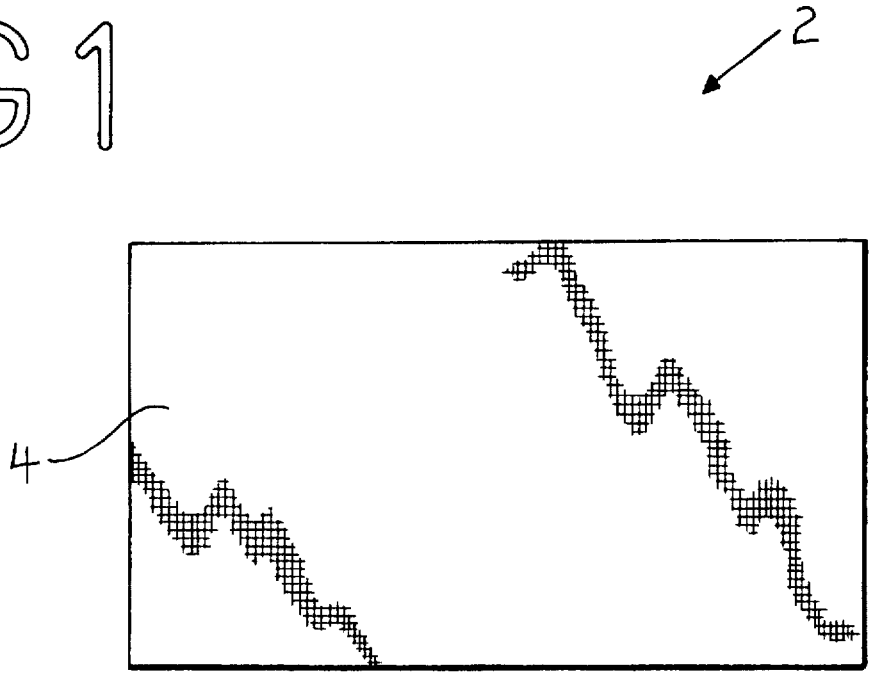
FIG. 1 is a top isometric view of a blanket with waterproof frictional backing.

FIG. 1 is a top isometric view of blanket with waterproof frictional backing 2. Upper layer top surface 4 is visible, and is generally the uppermost part of blanket with waterproof frictional backing 2. An occupant would sit on upper layer top surface 4.

Figure 2:
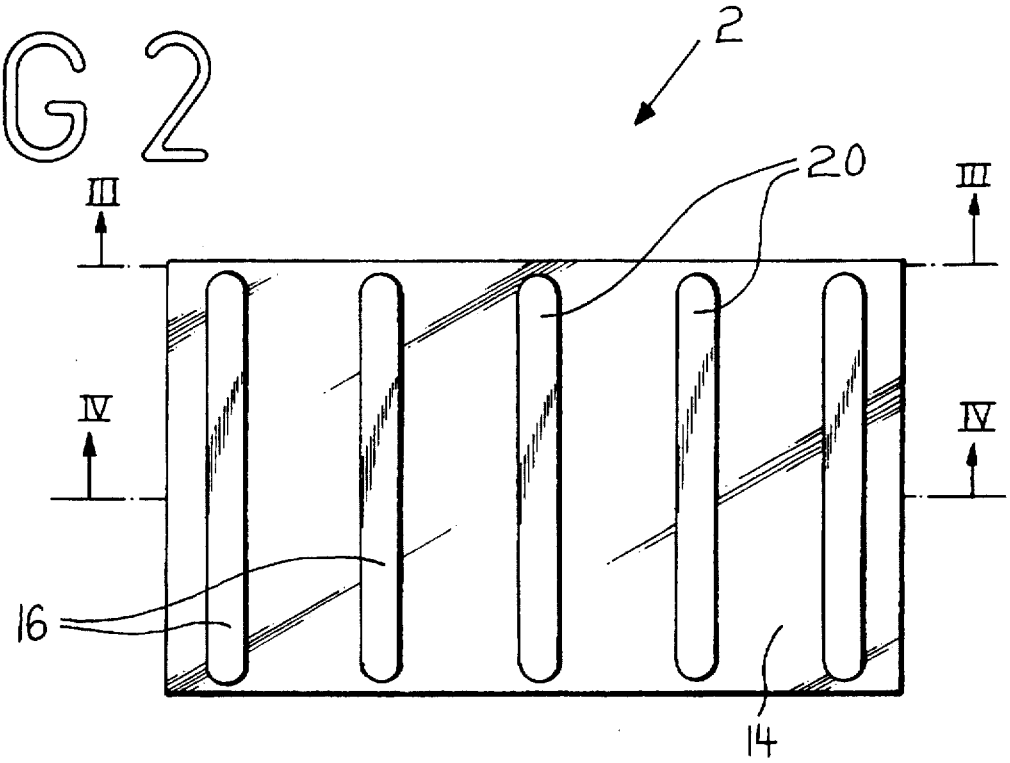
FIG. 2 is a bottom isometric view of a blanket with waterproof frictional backing.

FIG. 2 is a bottom isometric view of blanket with waterproof frictional backing 2. Frictional strips 16 are attached to lower layer bottom surface 14. Frictional strips 16 comprise frictional strip bottom surface 20, which is a non-slip type surface such as textured rubber, a non-slip synthetic, etc.

Figure 3:
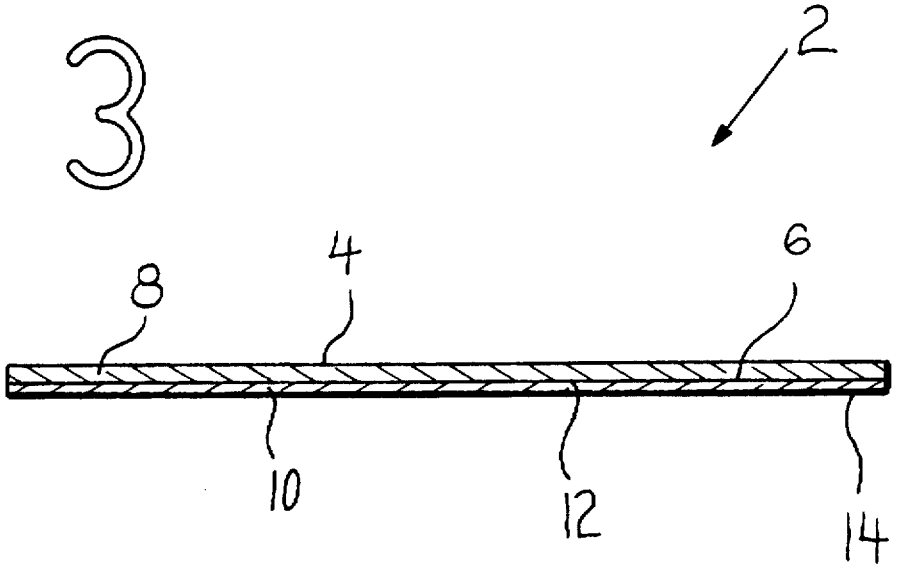
FIG. 3 is a side cross-sectional view of a blanket with waterproof frictional backing taken at section III—III of FIG. 2.
Figure 4:
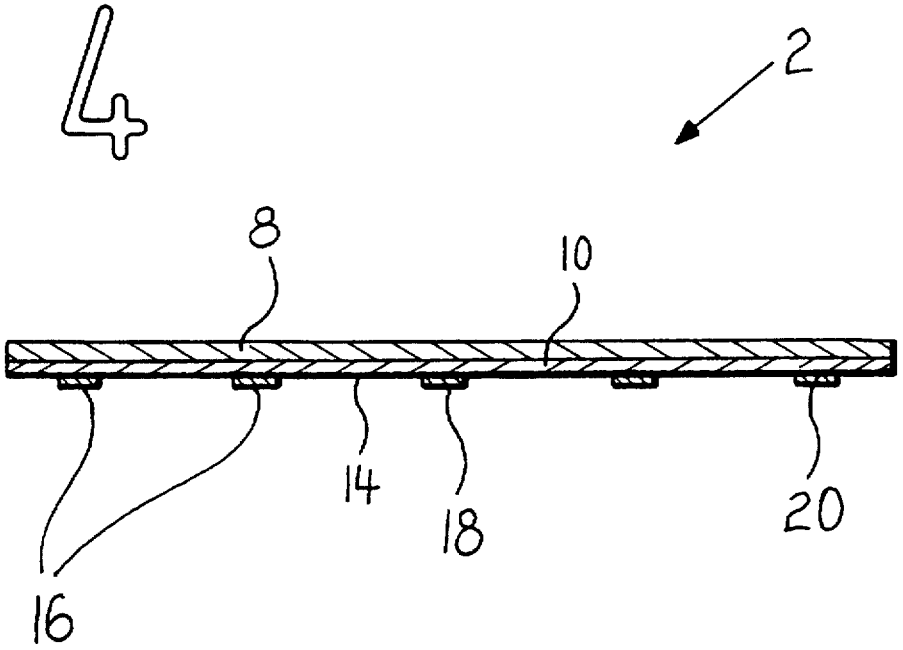
FIG. 4 is a side cross-sectional view of a blanket with waterproof frictional backing taken at section IV—IV of FIG. 2.

FIG. 3 is a side cross-sectional view of blanket with waterproof frictional backing 2 taken at section III—III of FIG. 2. Upper layer 8 comprises upper layer top surface 4 and upper layer bottom surface 6. Lower layer 10 comprises lower layer top surface 12 and lower layer bottom surface 14. Upper layer bottom surface 6 is attached to lower layer top surface 12. FIG. 4 is a side cross-sectional view of blanket with waterproof frictional backing 2 taken at section IV—IV of FIG. 2. Frictional strips 16 comprise frictional strip top surface 18 and frictional strip bottom surface 20. Frictional strip top surface 18 is attached to lower layer bottom surface 14. In the preferred embodiment, blanket with waterproof frictional backing 2 comprised a plurality of frictional strips 16 attached to lower layer bottom surface 14. However the scope of the invention contemplates an embodiment comprising only one frictional strip co-extensive with lower layer 10, so that a single frictional strip 16 covers the entirety of lower layer bottom surface 14.

In the preferred embodiment, upper layer 8 was a textile such as canvas, a soft towel material such as terrycloth, or other appropriate material. Lower layer 10 was a waterproof material such as plastic, rubber, nylon, or other appropriate waterproof material. Frictional strips 16 were fabricated of a material having a high coefficient of friction such as rubber, textured rubber, synthetic, or other appropriate material. Due to the inherent flexible nature of the above mentioned materials, blanket with frictional waterproof backing 2 is of flexible construction, and may readily be conveniently rolled-up for transportation or storage.

While a preferred embodiment of the invention has been illustrated herein, it is to be understood that changes and variations may be made by those skilled in the art without departing from the spirit of the appending claims.

DRAWING ITEM INDEX 2 blanket with waterproof frictional backing
4 upper layer top surface
6 upper layer bottom surface
8 upper layer
10 lower layer
12 lower layer top surface
14 lower layer bottom surface
16 frictional strip 18 frictional strip top surface
20 frictional strip bottom surface

I claim:

1. A blanket with waterproof frictional backing adapted to support substantial portions of a human body comprising:

a flexible, soft textile upper layer comprising an upper layer top surface and an upper layer bottom surface;

a waterproof, flexible lower layer comprising a lower layer top surface and a lower layer bottom surface, said upper layer bottom surface being attached to said lower layer top surface; and a plurality of frictional strips attached to said lower layer bottom surface, said frictional strips being of non-integral construction with said lower layer, whereby said blanket with waterproof frictional backing retains its flexible nature and may be conveniently rolled up for transportation and storage.

2. The blanket with waterproof frictional backing of claim 1 wherein said upper layer is terrycloth.

3. The blanket with waterproof frictional backing of claim 1 wherein said upper layer is canvas.

4. The blanket with waterproof frictional backing of claim 1 wherein at least one of said plurality of frictional strips comprises a frictional strip top surface and a frictional strip bottom surface, said frictional strip top surface being attached to said lower layer bottom surface.

5. The blanket with waterproof frictional backing of claim 4 wherein said frictional strip bottom surface has a high coefficient of friction.

6. The blanket with waterproof frictional backing of claim 5 wherein said frictional strip bottom surface is rubber.

7. A blanket with waterproof frictional backing adapted to support substantial portions of a human body comprising a flexible, soft textile upper layer attached to a coextensive waterproof, flexible lower layer, and a plurality of frictional strips attached to said lower layer, said frictional strips being fabricated of material having a high coefficient of friction, said frictional strips being of non-integral construction with said lower layer, whereby said blanket with waterproof frictional backing retains its flexible nature and may be conveniently rolled up for transportation and storage.

8. The blanket with waterproof frictional backing of claim 7 wherein at least one of said plurality of frictional strips is co-extensive with said upper layer and said lower layer.

* * * * *